US006923558B1

(12) United States Patent
Knighton et al.

(10) Patent No.: US 6,923,558 B1
(45) Date of Patent: Aug. 2, 2005

(54) FILAMENT ALIGNMENT MECHANISM FOR HIGH ACCURACY LAMPS

(75) Inventors: Mark S. Knighton, Santa Monica, CA (US); Kevin H. Vuong, Baldwin Park, CA (US); John Z. Zheng, San Gabriel, CA (US); David D. Drobnis, Mar Vista, CA (US)

(73) Assignee: NextEngine, Inc., Santa Monica, CA (US)

( * ) Notice: Subject to any disclaimer, the term of this patent is extended or adjusted under 35 U.S.C. 154(b) by 0 days.

(21) Appl. No.: 10/157,390

(22) Filed: May 28, 2002

(51) Int. Cl.[7] ..... F21V 21/00

(52) U.S. Cl. ..... 362/286; 362/285; 362/287; 362/526; 362/523; 362/418

(58) Field of Search ..... 362/285, 18, 286, 362/197, 508, 523, 526, 386, 418, 430, 429, 362/449, 512, 319, 529, 531, 513, 527, 530, 362/270, 271, 272, 287

(56) References Cited

U.S. PATENT DOCUMENTS 1,629,333 A * 5/1927 Benford ..... 362/287
4,395,750 A * 7/1983 Scheidemann et al. ..... 362/287
4,742,217 A 5/1988 Wilwerding
4,958,909 A 9/1990 Kubo
4,963,984 A 10/1990 Womack
5,689,339 A 11/1997 Ota et al.
5,707,128 A 1/1998 Dugdale
6,339,471 B1 1/2002 Morita

* cited by examiner

*Primary Examiner*—Thomas M. Sember
*Assistant Examiner*—Bao Q. Truong
(74) *Attorney, Agent, or Firm*—Blakely, Sokoloff, Taylor & Zafman, LLP

(57) ABSTRACT

A system for aligning a light source to a reflector on a frame for efficiently illuminating a target along a first axis of the reflector. The light source is coupled to an arm that is linearly translatable by a driver assembly coupled to the frame. The travel of the driver assembly is aligned to a plane defined by two axes of the reflector with an alignment pin coupled to the driver assembly and adjusted to the frame. The light source may then be aligned for travel in the first axis by mechanically isolating the drive mechanism from a malleable arm connected to the light source and by bending the malleable arm in at least one dimension.

15 Claims, 4 Drawing Sheets

FILAMENT ALIGNMENT MECHANISM FOR HIGH ACCURACY LAMPS

BACKGROUND OF THE INVENTION

1. Field of the Invention

The invention relates to light projectors. More particularly, the invention relates to accurate alignment of a light source in a projection system.

2. Related Art

Many systems exist that use a light source gathered by a reflector to be directed to a target. Example systems include everything from flashlights to the latest light projectors including digital light processing (DLP) projectors and liquid crystal display (LCD) projectors. Current example DLP projectors include the Proxima DP4200z projector from InFocus Corporation. Example LCD projectors include NEC's MultiSync MT800's and the NoteVision XG-NV1U manufactured by Sharp. Of concern for each of these products, is how much light ultimately reaches the target. This measure is typically reported in terms of American National Standards Institute (ANSI) lumens. Manufacturers often choose to obtain brighter illumination of a target by using refined optics including better lensing or brighter bulbs. These design choices typically increase the cost of the system. Besides resulting in increased cost, brighter bulbs typically fail sooner than more standard bulbs. All of these commercial systems, however, use bulbs with standardized connectors fixed to the product's frame.

BRIEF DESCRIPTION OF THE FIGURES

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION OF THE EXAMPLE EMBODIMENTS

A system is disclosed for accurately aligning a radiation source to a reflector in any system that illuminates a target with the radiation. One embodiment of the invention attempts to maximize illumination of the target given a certain radiation level. In the example embodiment of a visible light source projector with a filament based bulb, the alignment system takes into account that bulb is not a point source, but can rather be considered a two dimensional source of radiation. Alignment is made in the six possible degrees of freedom. Alignment in the X, Y, and Z directions is provided, as well as for yaw, pitch, and roll movement. Light illumination of a target may thus be improved by accurately aligning and then restraining movement of the filament in all but one axis. Any object aligned in first axis may be efficiently illuminated with adjustment of the bulb in only that one axis utilizing a drive mechanism. In one embodiment of the invention, alignment is facilitated using a malleable support arm connected between the bulb and the drive mechanism.

Figure 1:
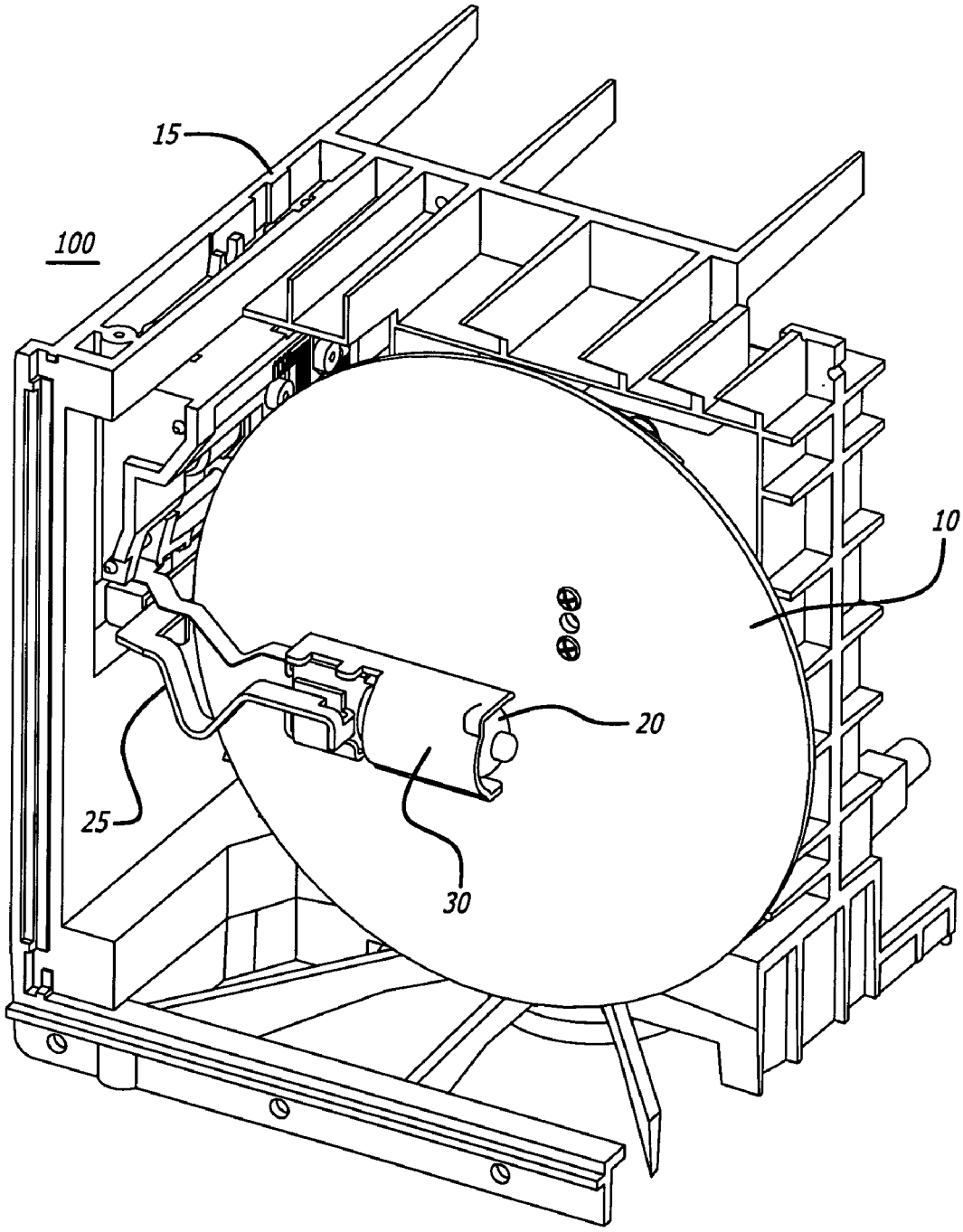
FIG. 1 is an isometric view of the filament alignment mechanism in the lamp system of the invention.

FIG. 1 shows filament alignment mechanism 100 with a reflector 10 connected to an external frame 15. The reflector 10 faces a light source 20 mounted on a distal end of bulb mount 25 for reflection of the light source 20 to a target 420 (See FIG. 4). The reflector 10 may be manufactured using polished aluminum or any other conventional manner. In an example embodiment, the reflector 10 may be composed of silver film, silver film laminates, anodized aluminum, dielectric-coated aluminum or even white paint used with or without a clear material such as borosilicate glass for durability. Reflector 10 is shown utilizing a parabolic shape with a circular cross section. In an alternative embodiment, a reflector 10 which is parabolic in one plane may be truncated (cut) in the other plane so that it is shortened in the cut dimension (truncated paraboloid). In another alternative embodiment, a parabolic cylinder that has a parabolic cross section in just one dimension may be used to be directive in one plane only. The parabolic cylinder shape may be optimized for a beam of radiated energy that is noticeably wider in one cross-sectional dimension than in another. It is within the scope and contemplation of the invention that any number of reflectors may be used to reflect the light source 20 towards the target 420 depending on the dimensions of the chosen target 420.

Figure 4:
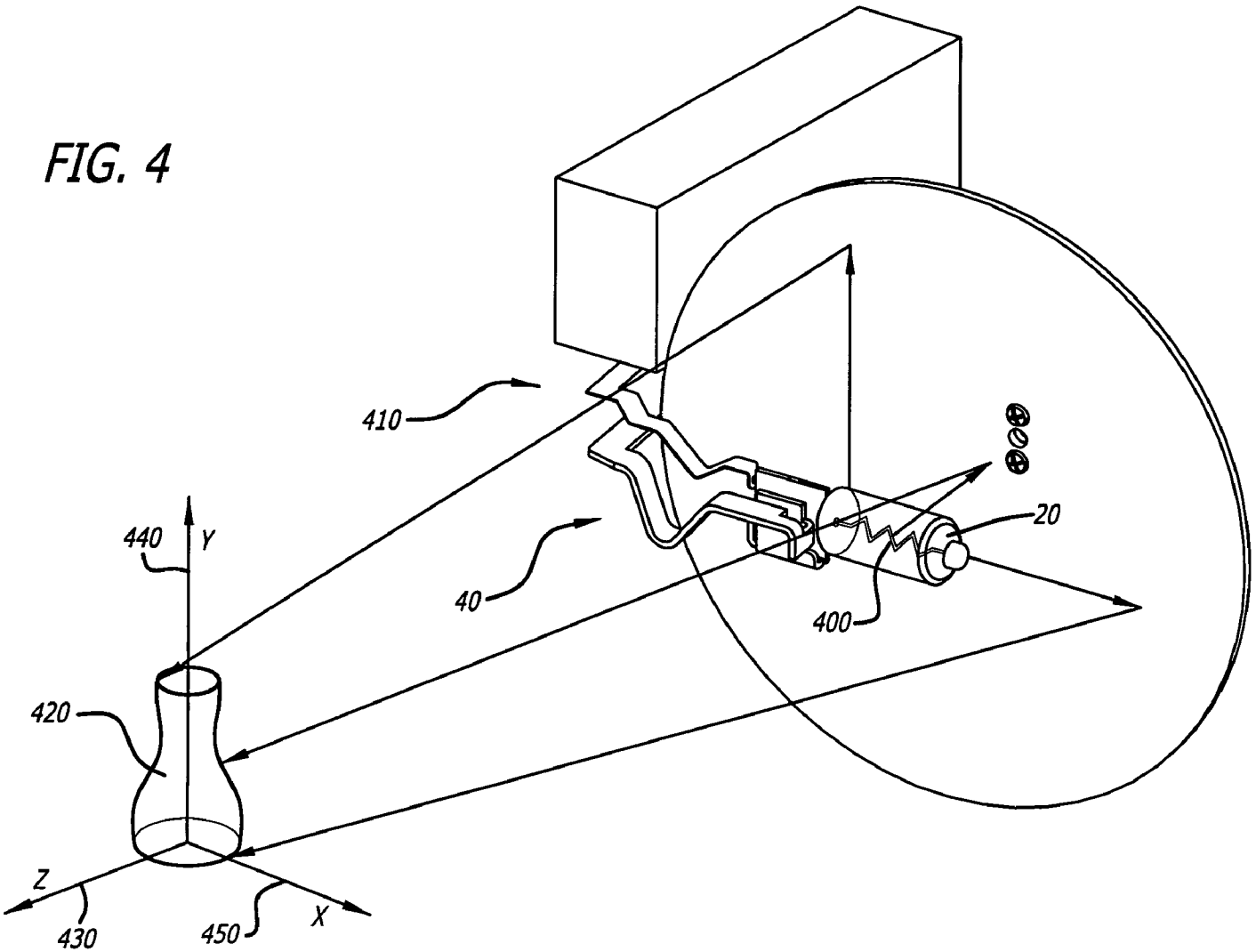
FIG. 4 is a schematic diagram of a filament of a light source aligned with a first axis of a reflector.

The light source 20 may be a halogen bulb having a filament 400 (See FIG. 4). An example embodiment of light source 20 may be of any of the family of bulbs having a filament or discreet light source. Examples include metal halide, vacuum or other gas filled bulbs having a filament. Alternative electromagnetic radiation sources for the light source 20 include a linear array of dipoles, a slit in the side of a waveguide, a thin waveguide radiator, a horn radiator fed by a waveguide, or a dipole such as an antenna.

Adjacent the light source 20 is a bulb blocker portion 30. The bulb blocker portion 30 forms a hemispherical or cylindrical shaped shield facing the light source 20 and the reflector 10. In this way, more radiation is captured and directed to the reflector 10 for greater illumination of the target 420 (See FIG. 4). In an example embodiment, bulb blocker portion 30 is formed of a reflective coating on a side of light source 20 or as part of the structure of light source 20 directing the electromagnetic radiation to the reflector 10.

Figure 2:
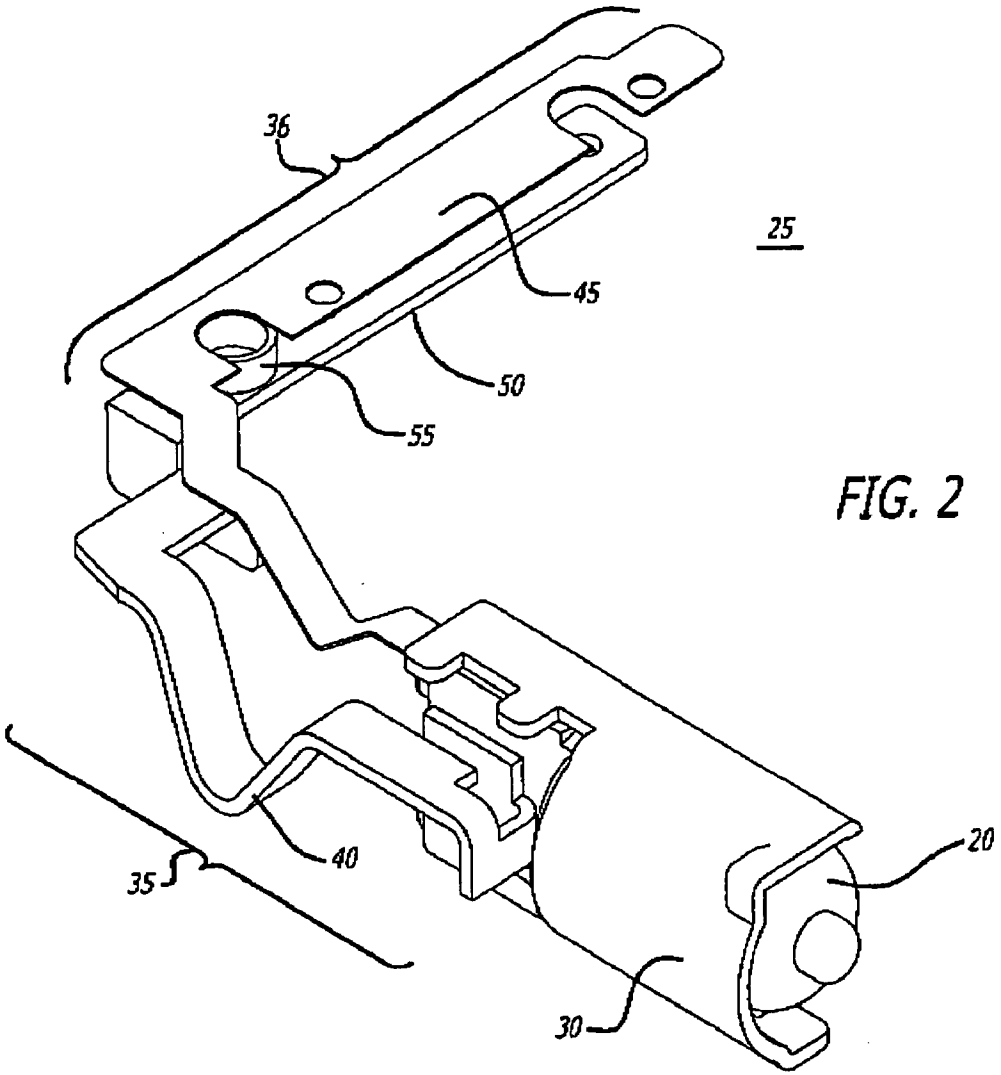
FIG. 2 is an isometric view of the bulb mount of the invention.

FIG. 2 shows the bulb mount 25 having a second support arm segment 35 extending at approximately a right angle from the first support arm segment 36 and having a malleable distal end 40. Bulb mount 25 is further described by an upper bulb lead 45 spaced vertically from a lower bulb mount portion 50 by an insulating spacer 55 and extending along the first and second support arm segments (36 and 35, respectively). The lower bulb mount portion 50 and upper bulb lead 45 may be formed of steel with the lower bulb mount portion forming the primary support for the light source 20. In an alternative embodiment, the first support arm segment 36 and second support arm segment 35 may form a slight angle or no angle to couple the light source 20 to a drive 300 (see FIG. 3). In an alternative embodiment, the lower bulb mount portion 50 may be formed of any substantially rigid and conductive material such as a metal or metal alloy, or formed using a combination of support material and conductive material having both the properties of malleability and conductivity. The upper bulb lead 45 and the lower bulb mount portion 50 provide electrical conductivity to the light source 20.

Malleable distal end 40 may have an accordion shape for better malleability and be molded or manufactured as part of a single piece defining lower bulb mount portion 50. In an alternative embodiment, malleable distal end 40 may be made of any variety of malleable or ductile conductive material, including aluminum, cooper, gold, a metallic alloy, or a combination of the above, and subsequently coupled to lower bulb mount portion 50. Although the malleable distal end 40 is shown with an accordion shape, it may take the form of any number of shapes to facilitate mechanical bending including "W" shapes and "C" shapes.

Bulb mount 25 is shown extending primarily in a horizontal plane, although it may extend in a vertical plane or be positioned radially from the center of the reflector 10 at a different angle from horizontal.

Figure 3:
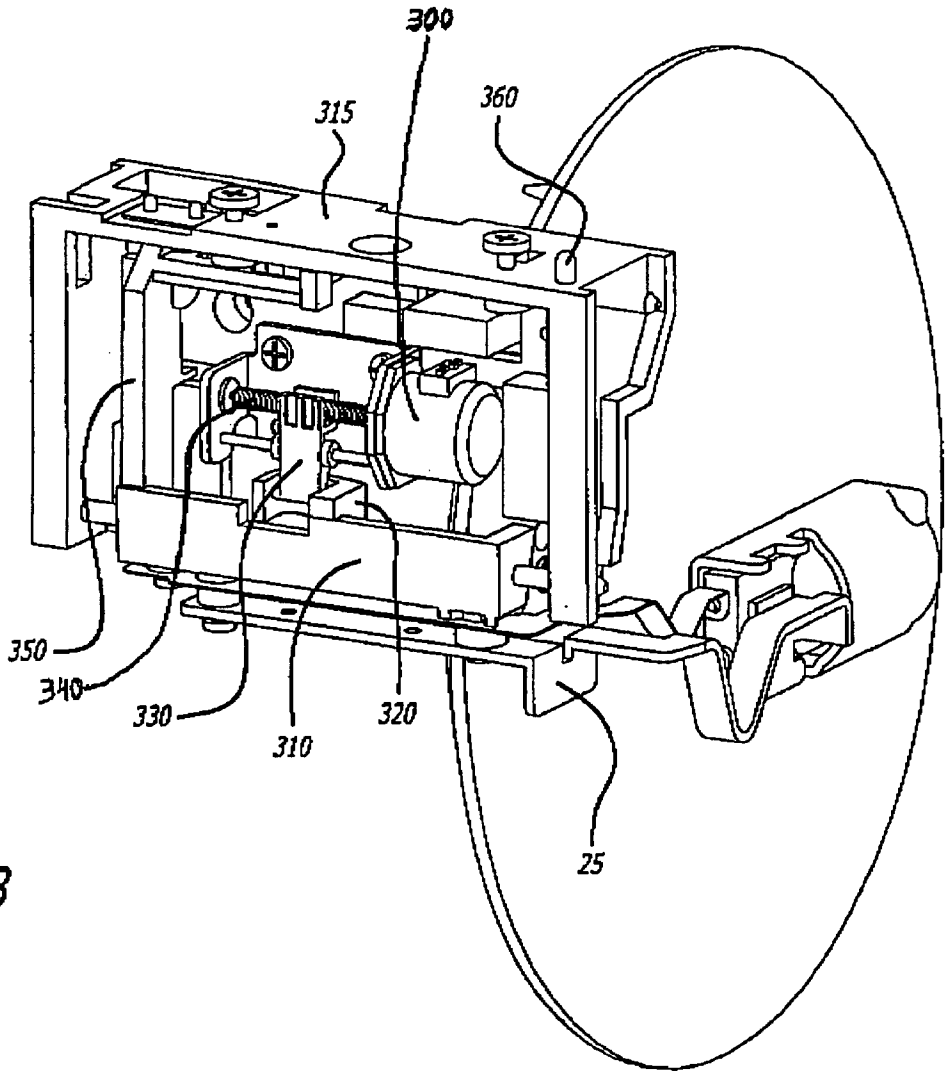
FIG. 3 is an isometric view of the driver and support arm segments of the invention.

Regarding FIG. 3, the bulb mount 25 is shown connected to the driver 300 by way of a bulb mount bearing 310 coupled to a nut follower portion 320 which in turn is coupled to lead screw nut 330 and hence to the lead screw 340 driven by the driver 300. The driver assembly 350, made collectively of parts 300–340, may be coupled to a local frame 315 in part by way of a bulb shaft alignment pin 360. With coupling of the driver assembly 350 with the local frame 315 using shaft alignment pin 360, the bulb mount 25 may be coupled to and aligned with external frame (15 in FIG. 1) and translated along first axis 430 of the reflector 10 (see FIG. 4).

In an exemplar embodiment, driver 300 may include any of the family of linear or electric actuators or linear slides. While driver 300 moves a lead screw 340 connected to a lead screw nut 330 in the depicted embodiment, any manner of linear driver assembly may be utilized. In alternative embodiments, a stepper driver may be used in combination with a track to translate the bulb mount 25. Gears may also be used in conjunction with a rack and pinion system in place of driver 300. Lead screw 340, lead screw nut 330 and nut follower portion 320 may be substituted by a timing belt. Lead screw 340 may also be replaced with a ball screw. Although bulb mount bearing 310 and nut follower portion 320 are shown as separate parts, they may be molded as one piece and coupled between the bulb mount 25 and lead screw nut 330. In an alternative embodiment, any suitable linkage may be used to translate the linear motion of the driver 300 to bulb mount 25.

FIG. 4 shows a filament 400 of light source 20 aligned with the first axis 430 of reflector 10. Alignment is made necessary by the inconsistent physical placement of the filament 400 within commercial filament based light sources 20. For example, the filament 400 may be offset towards either end of light source 20 in relation to its base. Also, not all light sources are of the same length, thereby placing the filament 400 of the light source 20 in different spatial positions in relation to the reflector 10. Alignment may be accomplished by mechanically isolating the malleable distal end 40 from the proximal end of the second support arm segment 410 thus isolating the malleable distal end 40 from the driver assembly 350. The malleable distal end 40 may then be adjusted in at least one dimension and/or angle in relation to the first, second and third axes (430, 440, and 450, respectively) such that the filament 400 is centered with respect to the three axes of the reflector 10. For example, roll of the filament 400 about the Z-axis may corrected through physical deformation of the malleable distal end 40. Likewise, pitch of the filament 400 about the X-axis may be correct through physical deformation of the malleable distal end 40. In this manner, movement along the Z-axis defined by the reflector 10 results in greater illumination of a target.

In an embodiment of the invention, a user merely places their eye along the Z-axis and adjusts placement of the filament 400 to the center of the reflector 10 through adjustment of the malleable distal end 40. In an alternative embodiment, the lamp 20 is illuminated and a target 420 chosen along the Z-axis such that the target's cast shadow verses the image of the filament is more definite. The malleable distal end 40 may then be mechanically isolated from the proximal end of the second support art segment 410 (thus isolating the lamp from the driver 300) and adjusted so that the definition of the target's shadow verses the image of the filament is increased. Upon completion, the filament 400 is centered with respect to the reflector 10 and the driver 300 is then able to translate the light source 20 linearly in the first axis 430, depending on the distance of a target 420 to the reflector 10, to increase illumination of the target 420.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An apparatus comprising:

a light source;

a driver to translate the light source linearly;

an arm having a first support arm segment coupled to the driver to permit the driver to translate the arm, a bulb lead, offset from and connected to a bulb mount through an insulating spacer, wherein the bulb lead conducts current for the light source; and a malleable second support arm segment extending from the first support arm segment bent to align the light source with a desired focal point on a parallel plane.

2. The apparatus of claim 1 further comprising:

an alignment pin coupled to the driver to align translation of the arm in a direction substantially perpendicular to a desired focal plane.

3. The apparatus of claim 1 further comprising;

a shade connected to a distal end of the second support arm segment.

4. The apparatus of claim 1 wherein the driver comprises:

an actuator.

5. The apparatus of claim 4 wherein the driver further comprises:

a lead screw coupled to the actuator;

a lead screw nut slideably coupled to the lead screw;

a nut follower portion coupled to the lead screw nut; and a bearing coupled between the nut follower portion and the first support arm segment to transfer movement from the lead screw to the first support arm segment.

6. An apparatus comprising:

an actuator;

a frame coupled to the actuator;

an arm having a first support arm segment coupled to the actuator to permit the actuator to translate the arm along an axis;

means for adjusting along at least one axis the position of a light source relative to the first support arm segment to align the light source on a parallel plane; and means for aligning the actuator to the frame to align a travel of the means for adjusting to a plane substantially perpendicular to the parallel plane.

7. A method comprising:

coupling a reflector to a frame;

coupling a light source to a malleable arm;

coupling the malleable arm to a drive mechanism coupled to the frame;

mechanically isolating the drive mechanism from the malleable arm;

bending the malleable arm in at least one dimension to align the light source with the reflector; and removing the mechanically isolating process between the drive mechanism and the malleable arm.

8. The method of claim 7 wherein the light source is a bulb having a filament.

9. The method of claim 7 further comprising:

adjusting an alignment pin coupled to the drive mechanism relative to the frame so that travel of the malleable arm remains in a plane substantially perpendicular to a desired focal plane.

10. An apparatus comprising:

a light source;

an arm providing support to the light source substantially along at least one axis of a reflector, wherein the arm comprises a bulb lead, offset from and connected to a bulb mount through an insulating spacer, wherein the bulb lead conducts current for the light source;

a zone of compliant material coupling the light source to the arm, the zone of compliant material allowing the light source to translate and rotate, independent of any articulated elements, relative to the reflector in response to an external operation to align the light source relative to the reflector; and the zone of compliant material maintaining the aligned light source position after completion of the external operation.

11. The apparatus of claim 10 further comprising:

a driver to linearly transport the light source after alignment.

12. The apparatus of claim 11 further comprising:

an alignment pin coupled to the driver to align translation of the arm in a direction substantially perpendicular to a desired focal plane.

13. The apparatus of claim 10 further comprising;

a shade connected to a distal end of the arm.

14. The apparatus of claim 11 wherein the driver comprises:

an actuator.

15. The apparatus of claim 14 wherein the driver further comprises:

a lead screw coupled to the actuator;

a lead screw nut slideably coupled to the lead screw;

a nut follower portion coupled to the lead screw nut; and a bearing coupled between the nut follower portion and the arm to transfer movement from the lead screw to the arm.

* * * * *